United States Patent [19]

Thompson et al.

[11] Patent Number: 4,953,868

[45] Date of Patent: Sep. 4, 1990

[54] GOLF SWING TRAINING DEVICE

[76] Inventors: Stanley C. Thompson, 2707 S. Fairfax Ave., Culver City, Calif. 90232; Elmer R. Fredericks, 5355 Caminito Providencia, Rancho Santa Fe, Calif. 92067

[21] Appl. No.: 441,044

[22] Filed: Nov. 24, 1989

[51] Int. Cl.[5] ..... A63B 69/36

[52] U.S. Cl. ..... 273/186 A; 84/330; 273/81 R

[58] Field of Search ..... 273/186 A, 186 R, 183 D, 273/193 R, 194 R, 162 R; 84/330 C

[56] References Cited

U.S. PATENT DOCUMENTS 4,116,108 9/1978 Hyman ..... 84/330 C 4,283,057 8/1981 Ragan ..... 273/186 A

*Primary Examiner*—George J. Marlo

*Attorney, Agent, or Firm*—William W. Haefliger

[57] ABSTRACT

A swing training device usable by a golfer comprises an elongated lightweight shaft adapted to be swung by a golfer to produce either a desirable accelerated or insufficiently accelerated swing, corresponding respectively to a desirably or insufficiently accelerated swing of a golf club, relative to a golf ball; and sound producing structure associated with the shaft to produce a distinctive audible sound when the shaft is swung so as to define a desirably accelerated swing.

9 Claims, 2 Drawing Sheets

GOLF SWING TRAINING DEVICE

BACKGROUND OF THE INVENTION

This invention relates generally to golf swing practice, and practice devices. More particularly, it concerns method and means to discriminate between a swing which produces too much acceleration, too soon, during simulated golf club swinging, and the right amount of acceleration, as at "point-of-impact" with a simulated ball.

When driving a golf ball from tee-off, it is most frequently desirable to achieve maximum driven distance of the ball, and directional accuracy is always sought. These objectives translate into maximum acceleration of the club head at point of impact, together with accurate swinging of the head in the desired plane for directional accuracy. There is need for a practice device which, when swung, will detect and indicate to the golfer that he has swung the device in such manner as to simulate an actual golf club swing that produces maximum acceleration of the club head at point of impact with a golf ball, and with swing plane accuracy.

SUMMARY OF THE INVENTION

It is a major object of the invention to provide method and means for meeting the above need. Basically, the training device of the invention comprises:

(a) an elongated lightweight shaft adapted to be swung by a golfer to produce either a desirably accelerated or insufficiently accelerated swing, corresponding respectively to a desirably or insufficiently accelerated swing of a golf club, relative to a golf ball, and (b) means associated with the shaft to produce a distinctive audible sound when the lightweight shaft is swung so as to define a desirably accelerated swing.

As will be seen, the device typically has the manual "feel" of a golf club; also, it has holes or openings in a shaft tubular portion that are such as to cause production of the distinctive audible sound, as referred to, when the device is correctly swung and accelerated.

These and other objects and advantages of the invention, as well as the details of an illustrative embodiment, will be more fully understood from the following specification and drawings, in which:

DRAWING DESCRIPTION

DRAWING DESCRIPTION

Figure 1:
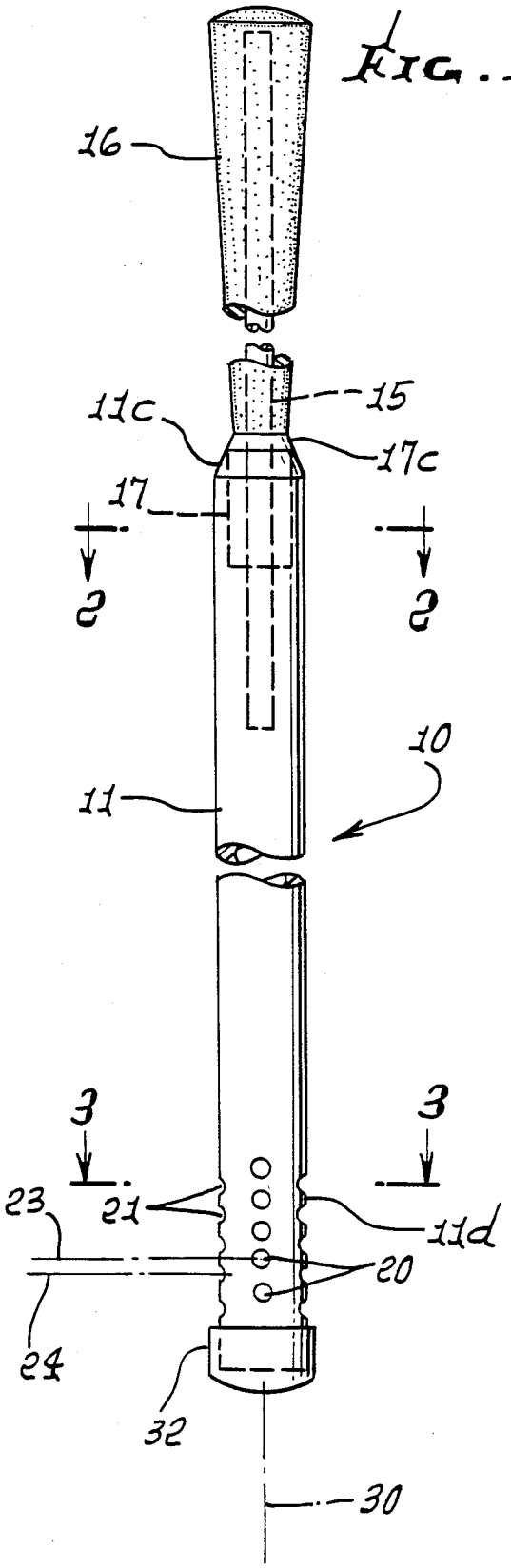
FIG. 1 is an elevation showing a golf swing training device incorporating the invention.
Figure 2:
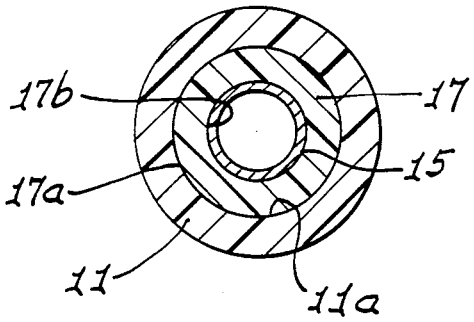
FIG. 2 is an enlarged section taken on lines 2—2 of FIG. 1.
Figure 3:
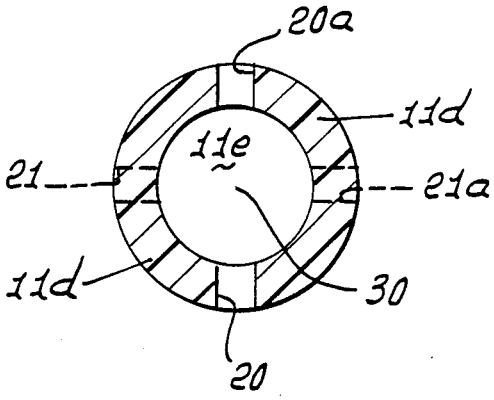
FIG. 3 is an enlarged section taken on lines 3—3 of FIG. 1.
Figure 4:
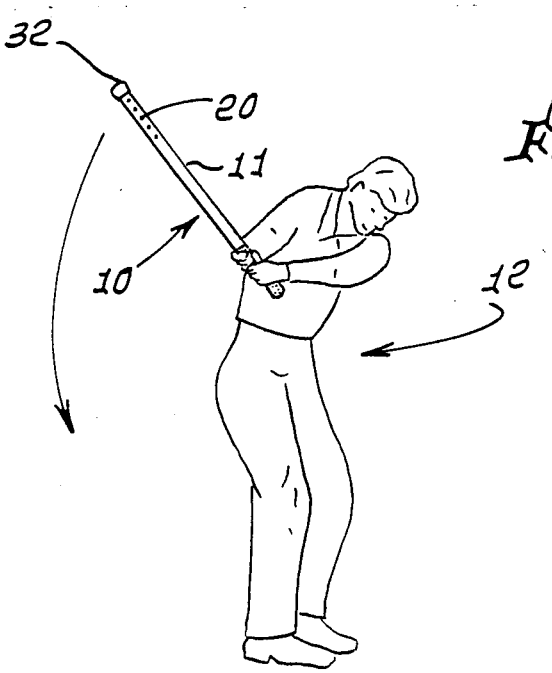
FIGS. 4 and 5 are elevations showing use of the training device.
Figure 5:
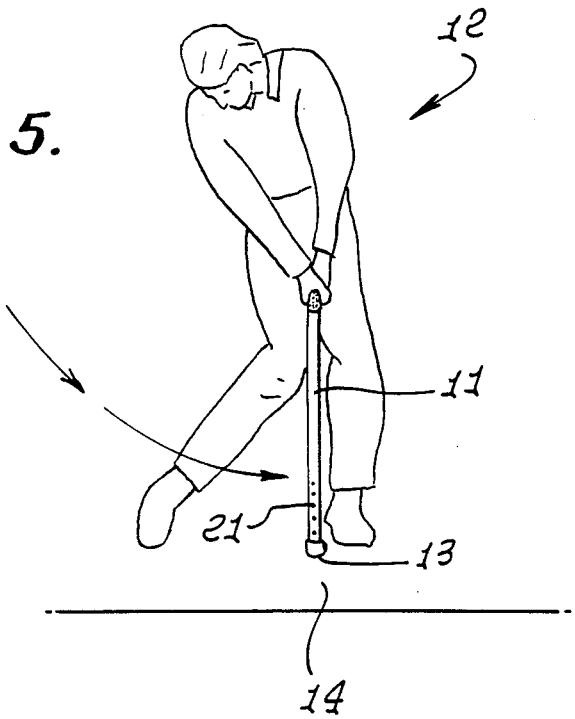

In accordance with the invention, the device 10 includes an elongated, lightweight shaft 11 adapted to the swing by a golfer 12, as seen in FIGS. 4 and 5 to produce either a desirably accelerated or insufficiently accelerated swing, corresponding to a desirably accelerated or insufficiently accelerated swing of a golf club, relative to a golf ball. FIG. 4 shows the golfer holding the device in an elevated position to be swung downwardly in an arc, as in the swinging of a golf club. FIG. 5 shows the device being swung the same as in a golf club swing, with the lower end 13 of the device traveling forwardly above the location 14 where a golf ball would normally be on the ground.

Pursuant to an important aspect of the invention, means is associated with the shaft 11 to produce a distinctive, audible sound when the device is swung in a manner so as to be or define a desirably accelerated swing, as in FIG. 5. The audible sound resembles a whistle. If the swinging of the device is not sufficiently accelerated, the whistle sound is either not produced, or is greatly attenuated. Thus, the training device can be easily used by a golfer to practice his swing to produce desirable arm and wrist motion that results in sharp acceleration of a swung golf club to produce maximum velocity of the head at club head impact with a ball.

More specifically, the shaft 11 may consist of synthetic resin, such as polyvinyl chloride, and may be tubular as shown. Connected to the tubular plastic shaft 11 is an upper section 15 of a golf club shaft, the latter carrying the usual grip 16, whereby the user is provided with the normal manual "feel" of a golf club as he uses the device. While the connection of the section 15 to the tubular plastic shaft may take various forms, one such connection of unusual simplicity and effectiveness includes a tubular plastic (PVC) plug 17 having its outer surface 17*a* received in and adhesively bonded to the upper end bore 11*a* of the shaft 11. The plug inner surface or bore 17*b* is adhesively bonded to the outer surface of the golf club shaft section 15 received through the plug, and extending within the upper extent of the lightweight shaft 11. The handle or grip 16 protrudes from the shaft 11 and plug 17 for normal grasping. The uppermost ends of the shaft 11 and plug 17 may be smoothly tapered, as shown at 11*c* and 17*c*. Typically, plug 17 may, for example, consist of synthetic resin, and the shaft section 15 may consist of metal such as steel.

The tubular shaft 11 has a lower portion 11*d* that is adapted to be accelerated as the shaft is swung in a plane carrying lower portion 11*d* downwardly and forwardly past approximate alignment with the position normally occupied by a golf ball, as in FIG. 5. The means for producing the distinctive, audible sound comprises holes extending in shaft 11, sidewardly from the hollow interior 11*e* of the shaft to the exterior of the latter. As shown, the holes extend through opposite sides of the shaft portion 11*d*, and are spaced apart lengthwise of the shaft.

In the example shown, which is very effective, a first series of holes 20 extends through one side of the shaft portion 11*d*; and a second series of holes 20*a* extends through the opposite side of the shaft. Each hole 20 aligns with a hole 20*a*, and the row of holes 20 extends parallel to the shaft axis 30, as does the row of holes 20*a*. Similarly, a third series of holes 21 extends through another side of the shaft portion 11*d*, and a fourth series of holes 21*a* extends through the opposite side of the shaft portion 11*d*. Each hole 21 aligns with a hole 21*a*, and each row of holes 21 and 21*a* extends parallel to shaft axis 30. Accordingly, the effectiveness of the device does not depend upon its gripped position about axis 30.

The holes in each row are typically spaced apart, axially at equal intervals; however, holes 20 and 20*a* are staggered relative to holes 21 and 21*a*, i.e., the lateral planes 23 passing through the holes 20 and 20*a* are axially offset from the lateral planes 24 passing through the holes 21 and 21*a*. Planes 23 and 24 are normal to axis 30.

Merely as illustrative, the holes in each row may be spaced apart at about 1 inch intervals, center to center, and the holes themselves may be about ¼ inch in diameter. Shaft 11 is about ¾ inches in overall diameter.

The lower open end of the tubular shaft 11 is closed, as by a cap 32. The cap skirt may frictionally grip the shaft lower end outer surface.

In use, and starting from FIG. 4 position, the user starts his down-swing as by transferring weight to his left side, which causes the hands on the grip 16 to "uncock", and to develop acceleration and high velocity at the device lower portion 11*d*. As long as one swings to accelerate the device "through the hole", i.e., to and through FIG. 5 position, until the device is swung 18 to 20 inches past the theoretical point of impact with the ball, and stance balance is maintained during body rotation, the desired acceleration to produce the distinctive audible sound will be produced. This corresponds to desired drive distance and directional accuracy of a driven ball, when an actual golf club is employed. By swinging slightly toward one o'clock, the user's body weight will be "behind the ball" at point of theoretical impact, producing desired club head speed and power.

It is found if the user's swing is correct, and device acceleration is "through threshold", the desired audible whistle sound will occur audibly plainly as the theoretical point of impact is passed. If too much emphasis put upon the down swing, the audible sound will occur prior to point of impact, which is not desirable. Thus, the training device is capable of differentiating between a club swing which produces too much acceleration too soon, and which, on the other hand, produces the right amount of acceleration at "point of impact".

We claim:

1. In a swing training device usable by a golfer, the combination comprising (a) an axially elongated lightweight tubular shaft adapted to be swung by a golfer to produce either a desirably accelerated or insufficiently accelerated swing, corresponding respectively to a desirably or insufficiently accelerated swing of a golf club, relative to a golf ball, the shaft having a longitudinal bore and an exterior surface, (b) the shaft having, and confined near one end thereof, through holes intersecting said bore and said exterior surface, to produce a distinctive audible sound when said lightweight shaft is swung so as to define a desirably accelerated swing, the holes spaced about said axis, (c) means for closing said one end of the tubular shaft, (d) and a golf club shaft section extending into the opposite end of the tubular shaft, remotely from said holes and being bonded to said bore, and a golf club grip on said golf club shaft section, exteriorly of said tubular shaft.

2. The device of claim 1 wherein said holes extend through opposite sides of the tubular portion.

3. The device of claim 1 wherein said holes are spaced apart lengthwise of the shaft.

4. The combination of claim 1 wherein said lightweight shaft consists of synthetic resin.

5. The combination of claim 1 wherein the shaft is upright, and including a cap on and closing the lowermost end of said tubular portion.

6. The combination of claim 5 wherein said holes include groups of holes spaced about an axis defined by the shaft at about 90 degree intervals.

7. The combination of claim 6 wherein the holes of each group are spaced apart lengthwise of the shaft.

8. The combination of claim 7 wherein the holes of successive groups, about the shaft axis, are staggered, axially.

9. The combination of claim 1 including a tubular closure cap fitting over and bonded to the tubular shaft, at said one end thereof, proximate said holes.

* * * * *